US005815867A

United States Patent [19]

Keasler et al.

[11] Patent Number: 5,815,867

[45] Date of Patent: Oct. 6, 1998

[54] PRETREATMENT OF YARN AND SUBSEQUENT DYEING OF YARN OR FABRIC WOVEN THEREWITH

[76] Inventors: Thomas J. Keasler, 146 Nicholson Rd., Winston-Salem, N.C. 27107; Allen V. Hardy, III, 4425 Lindsey St.; Darren K. Barnes, P.O. Box 423, both of Kernersville, N.C. 27284; Tony M. Leonard, 141 Lake Pine Rd., Mooresville, N.C. 28115; Larry W. Strickland, 2900 Litchfield Dr., Browns Summit, N.C. 27214

[21] Appl. No.: 805,655

[22] Filed: Feb. 27, 1997

[51] Int. Cl.[6] ..... D06B 3/06

[52] U.S. Cl. ..... 8/149.1; 8/151.2; 68/5 D; 68/9; 68/13 R; 68/22 R; 68/181 R

[58] Field of Search ..... 8/149.1, 150, 151.2, 8/481; 68/5 D, 9, 13 R, 22 R, 181 R; 139/36; 66/125 A

[56] References Cited

U.S. PATENT DOCUMENTS

| | | | |
|---|---|---|---|
| 2,754,330 | 7/1956 | Schreyer . | |
| 3,775,054 | 11/1973 | DeVinney | 8/151.2 X |
| 4,035,145 | 7/1977 | Gipp et al. . | |
| 4,118,183 | 10/1978 | Godau et al. | 8/151.2 X |
| 4,246,668 | 1/1981 | Spellmann et al. | 8/151.2 X |
| 4,436,521 | 3/1984 | Annen et al. . | |
| 4,586,934 | 5/1986 | Blalock et al. | 8/151.2 X |
| 4,615,709 | 10/1986 | Nakao . | |
| 4,764,585 | 8/1988 | Heller et al. . | |
| 4,834,769 | 5/1989 | Dien et al. . | |
| 5,330,538 | 7/1994 | Teague et al. | 8/151.2 X |
| 5,330,541 | 7/1994 | Hall et al. . | |
| 5,489,313 | 2/1996 | Hall et al. . | |

*Primary Examiner*—Philip R. Coe
*Attorney, Agent, or Firm*—Nixon & Vanderhye, P.C.

[57] ABSTRACT

A first yarn (21) undergoes a pretreatment process (22) for saturation with a pretreatment solution. In the pretreatment process, the first yarn is supplied to continuously travel through a first bath ($100_2$) and a second bath ($100_3$) of the pretreatment solution. The first bath has a volume ($V_2$) which is less than a volume of the second bath ($V_3$). Between the first and second baths the pretreatment solution is impressed into the continuously moving first yarn. After the second bath only excess pretreatment solution is removed from the moving yarn, thereby keeping the yarn saturated when it enters a heat treatment (42) for locking the pretreatment solution into the yarn. The first yarn can be subsequently dyed in the same operation or maintain its original appearance (either colored or non-colored). The first yarn can be a warp yarn or weft yarn which, together with either a second yarn (weft or warp yarn, treated or untreated), is woven into a fabric piece (26). Either the fabric piece, or a textile article (28) formed therefrom, is then introduced into a subsequent, specialized dyeing process (30). In the specialized dyeing process, an anionic type dye (such as a direct, fiber-reactive, etc. type dye) is attracted only to the pretreated yarn, so that only the pretreated yarn is colored (dyed or tinted) and the untreated yarn is substantially unchanged.

20 Claims, 3 Drawing Sheets

PRETREATMENT OF YARN AND SUBSEQUENT DYEING OF YARN OR FABRIC WOVEN THEREWITH

BACKGROUND

1. Field of Invention

This invention pertains to pretreatment of yarns such as yarns used for making fabrics, and particularly to processing differentially colored fabrics, such as denim, for example.

2. Related Art and Other Considerations

Some types of fabrics, such as denim, are formed by weaving a warp yarn and a weft yarn. Historically the warp yarn is dyed to a desired color before weaving; the weft yarn is not dyed. As used herein, the term "natural" and "natural color" refers to a yarn or fabric that is not dyed.

In a typical denim production process, warp yarn from several ball warps are dyed and then spooled onto beams. Prior to weaving, the dyed warp yarn is unspooled for feeding to a slashing operation (for applying a sizing film to the yarn). Thereafter the dyed warp yarn is fed to the weaving machine. In the weaving machine, the dyed warp yarn is fed in a warp direction while the undyed weft yarn is fed in a cross direction. Large samples of denim woven by the weaving machine can later be utilized to prepare a finished textile good, e.g. an article of clothing.

In a typical prior art continuous long chain dyeing process, the warp yarn is first fed into a series of processing boxes. Each processing box is filled with a processing liquor. The component of liquor introduced into these processing boxes depends on whether the processing boxes are used for dyeing, chemical treatment, or a wash process. For example, a dyeing liquor is often utilized in the first boxes for a dyeing process. A series of rollers in the boxes are situated so that the warp yarn can have an essentially serpentine path through the box, e.g. the warp yarn passing alternately under vertically lower rollers in the box and over upper rollers in the box. Upon emerging from each box, the warp yarns are directed through a pair of nip rollers. Upon exiting the nip rollers of the first box, the warp yarn can either enter a second processing box, or be fed further downstream. Likewise, upon exiting the nip rollers at the exit of the last processing box, the warp yarn can be directed into a steamer. The steamer is a chamber through which the warp yarn (e.g., dye-laden warp yarn) travels, again in a serpentine path. The steamer can be operated at an elevated temperature, e.g. 210° F., if desired. Upon exiting from the steamer, the warp yarn is directed through a plurality of further processing or developing boxes, e.g., for dyeing and/or for removing excess dye which did not lock into the warp yarn.

Apart from the field of differentially dyed colored fabrics, pre-dyeing treatments have been developed to enhance color while using less dye. U.S. Pat. Nos. 5,489,313 and 5,330,541 to Hall et al., both incorporated herein by reference, teach processes for increasing the dyeability of textile fibers and fabrics without the need to use a salt in the dye bath. The processes of these patents involve pretreatments of textile fibers or fabrics conducted in a batch or package dyeing mode prior to dyeing in a bath or package dye mode, not in a continuous long-chain dyeing operation as is required for commercial production of denim, for example.

What is needed, therefore, and an object of the present invention, is the method and apparatus for conducting a pretreatment dye-enhancing operation for continually traveling yarn.

SUMMARY

A first yarn undergoes a pretreatment process for saturation with a pretreatment solution. In the pretreatment process, the first yarn is supplied to continuously travel through a first bath and a second bath of the pretreatment solution. The first bath has a volume which is less than a volume of the second bath. Between the first and second baths the pretreatment solution is impressed into the continuously moving first yarn. After the second bath only excess pretreatment solution is removed from the moving yarn, thereby keeping the yarn saturated when it enters a heat treatment for locking the pretreatment solution into the yarn. The first yarn can be subsequently dyed in the same operation or maintain its original appearance (either colored or non-colored). The first yarn can be a warp yarn or weft yarn which, together with either a second yarn (weft or warp yarn, treated or untreated), is woven into a fabric piece. Either the fabric piece, or a textile article formed therefrom, is then introduced into a subsequent, specialized dyeing process. In the specialized dyeing process, an anionic type dye (such as a direct, fiber-reactive, etc. type dye) is attracted only to the pretreated yarn, so that only the pretreated yarn is colored (dyed or tinted) and the untreated yarn is substantially unchanged.

BRIEF DESCRIPTION OF THE DRAWINGS

The foregoing and other objects, features, and advantages of the invention will be apparent from the following more particular description of preferred embodiments as illustrated in the accompanying drawings in which reference characters refer to the same parts throughout the various views. The drawings are not necessarily to scale, emphasis instead being placed upon illustrating the principles of the invention.

DETAILED DESCRIPTION OF THE DRAWINGS

In the following description, for purposes of explanation and not limitation, specific details are set forth in order to provide a thorough understanding of the present invention. However, it will be apparent to those skilled in the art that the present invention may be practiced in other embodiments that depart from these specific details. In other instances, detailed descriptions of well known devices, techniques, and methods are omitted so as not to obscure the description of the present invention with unnecessary detail.

The present invention concerns both the pretreatment of yarn in a continuous long-chain operation and the dyeing of the pretreated yarn. The dyeing of the pretreated yarn can be in the same continuous long-chain operation and/or subsequently as part of a fabric in a specialized dyeing operation. The fabric is made from the pretreated yarn and a second yarn (either pretreated or not). In the subsequent specialized dyeing operation of the fabric woven with the pretreated yarn, only the pretreated yarn is colored by the dyeing process. Any untreated yarn in the fabric is not colored by the dyeing process.

Figure 1:
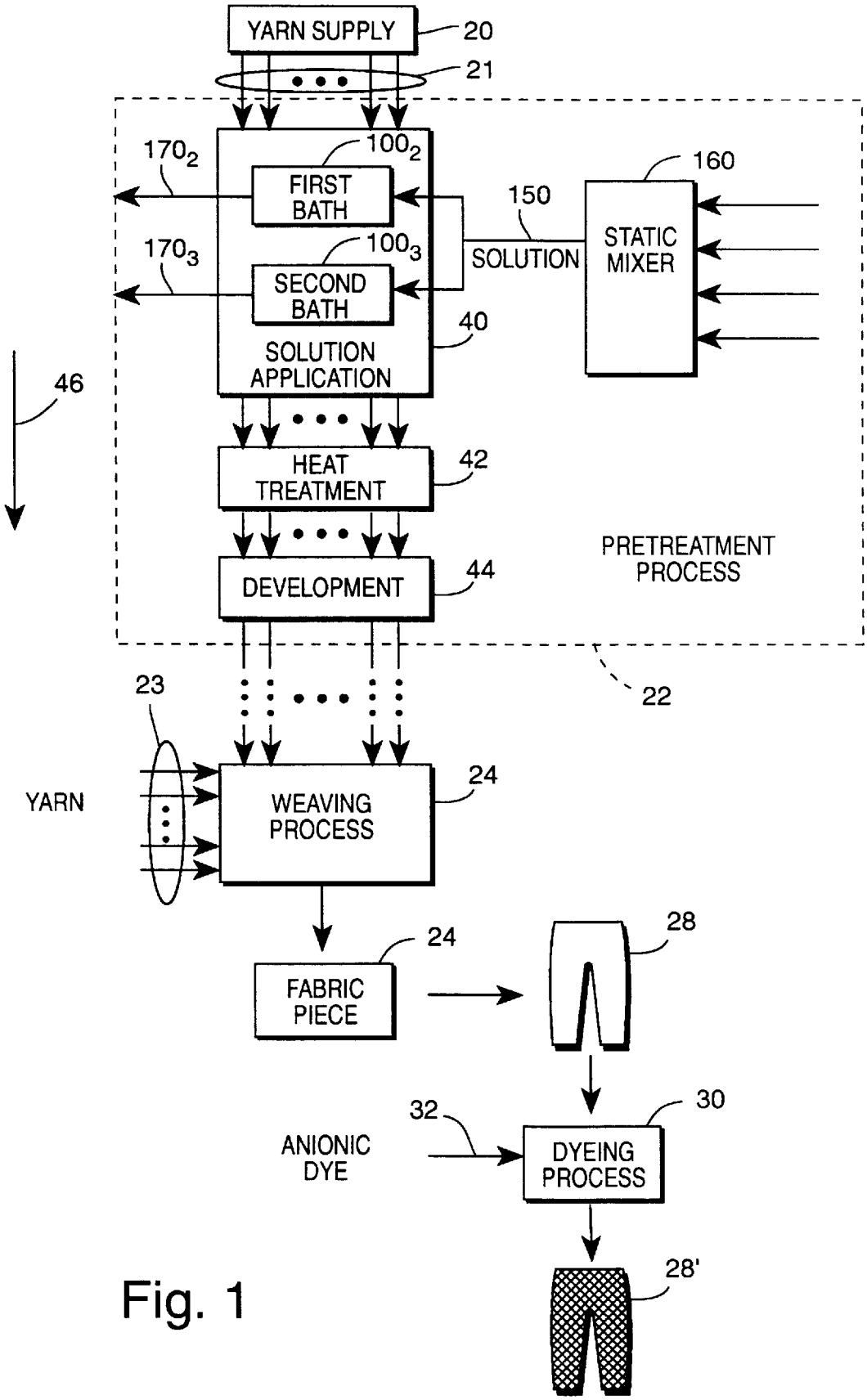
FIG. 1 is a schematic diagrammatic view of a yarn pretreatment process and fabric production process according to an embodiment of the invention.

FIG. 1 shows diagrammatically various steps involved in the invention. A yarn supply 20, such as a plurality of ball warps, essentially continuously feed first yarn 21 into a pretreatment process (generally depicted by broken line 22).

Yarn 21 travels through the pretreatment process 22 in an essentially continuous manner to absorb a dye pretreatment solution. Yarn which has absorbed the dye pretreatment solution is referred to herein as "pretreated" or "treated" yarn. First yarn 21 exits pretreatment process 22 with its original appearance (either colored or uncolored, as the case may be). Then, both the first yarn 21 which has undergone the pretreatment process 22 and a second yarn are separately fed to a weaving process 24 at a weaving machine in order to produce a fabric, indicated as fabric piece 26 in FIG. 1. Thereafter, fabric piece 26 can be made into a textile article 28, such as pants (jeans). When the article manufacturer determines a desirable color, article 28 is loaded into a dyeing process 30 with a dye 32. In dyeing process 30, dye is attracted only to treated yarn, not the untreated yarn. Thus, colored article 28' emerges from dyeing process 30. Colored article 28' will be differentially dyed if both treated and untreated yarns are employed in the fabric from which article 28 is produced. Alternatively, colored article 28' will be solid if both treated first yarn and treated second yarn are utilized in the fabric.

The first yarn utilized in the present invention can be dyed subsequent to preprocessing with the pretreatement solution but before woven into fabric piece 26, as occurs in a first example described hereinafter. Alternatively, as in a second example, the treated yarn can remain undyed after the preprocessing, so that an uncolored or originally colored fabric piece 26 is woven. In the former mode, the dyed treated yarn of the fabric piece is further dyed or tinted after being woven. In the latter mode, on the other hand, the treated yarn remains in its original colored or uncolored state and receives no additional coloration until after being woven into fabric piece 26.

As a modification of the steps shown in FIG. 1, it should be understood that fabric piece 26 need not be formed into article 28 prior to dyeing process 30. Instead, fabric 26 can be introduced in the piece to dyeing process 30, and thereafter an article be fabricated therefrom if desired. Moreover, it should also be understood that additional processes, understood by those skilled in the art, are typically included, such as, for example, beaming, slashing and winding processes conducted between pretreatment process 22 and weaving process 24.

In FIG. 1, yarn 21 is diagrammatically depicted as a series of lines essentially continuously extending through pretreatment process 22. It will be appreciated that these lines depict hundreds of individual yarns, and that the arrows shown on the lines merely indicate direction of travel of yarn 21 through pretreatment process 22. As will be understood from the ensuing discussion of FIG. 3, yarn 21 essentially continuously travels through each of a plurality of stages 40, 42, and 44 in pretreatment process 22. As used herein with reference to the transport of yarn 21, "essentially continuously" means that, for a given job, yarn 21 travels through pretreatment process 22 at a non-zero velocity in the general direction depicted by arrow 46, allowance for interrupts being made for change of yarn supply or for equipment operational/maintenance purposes and the like. "Essentially continuously" specifically excludes incremental movement (i.e., often repeated start and stop) of yarn 21 through pretreatment process 22.

As shown in FIG. 1, the stages of pretreatment process 22 include solution application stage 40; heat treatment stage 42; and, development stage 44. Development stage 44 can be one or more of a dyeing stage, a wash stage, or chemical processing stage.

Figure 3:
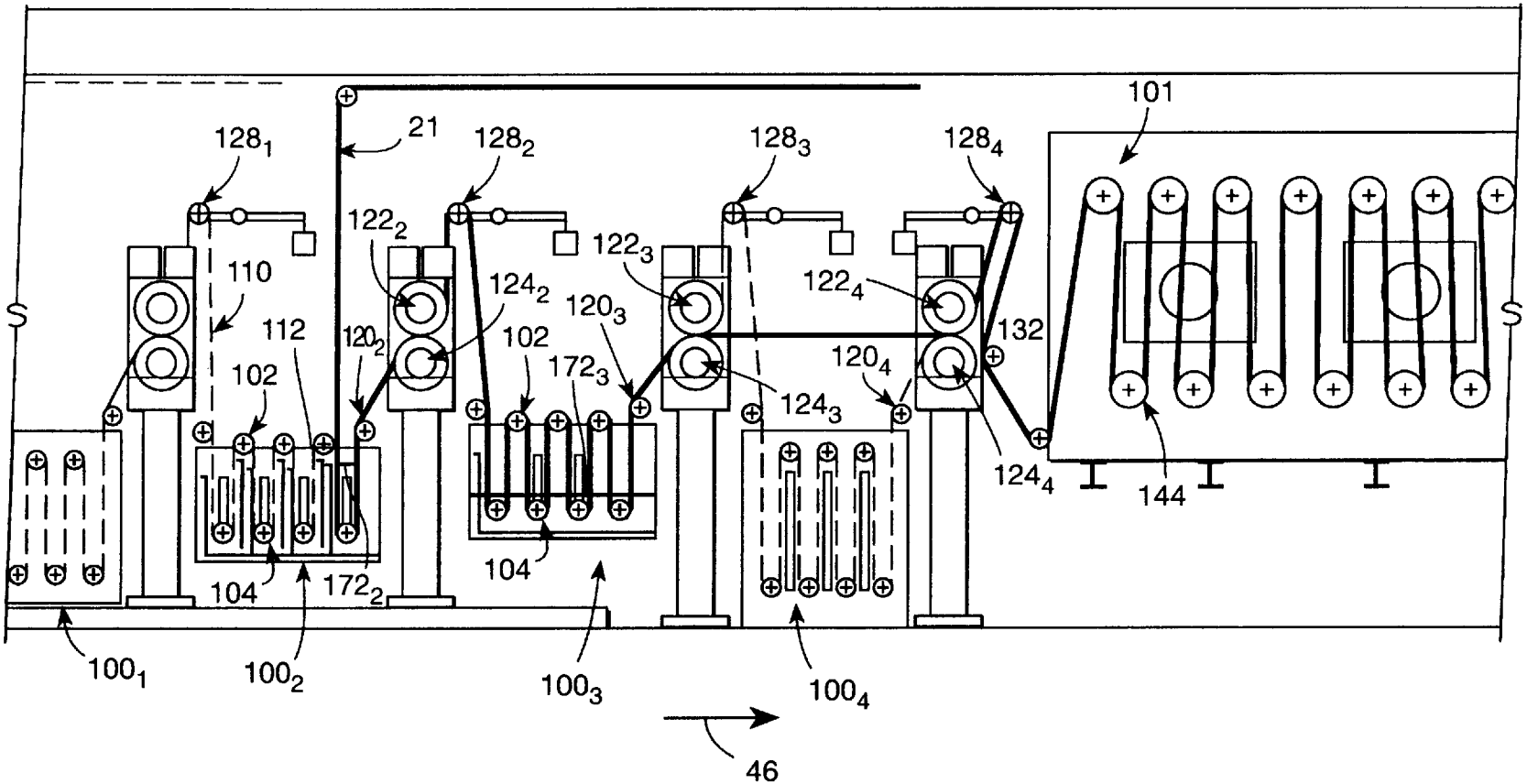
FIG. 3 is a side view of yarn pretreatment apparatus according to an embodiment of the invention.

Apparatus for performing solution application stage 40 and heat treatment stage 42 is shown in FIG. 3. FIG. 3 shows parts of a conventional continuous long chain dyeing operation, including portions thereof which have been particularly configured and adapted as described herein to accomplish solution application stage 40 of the present invention. In particular, FIG. 3 shows a plurality of boxes or tanks $\mathbf{100}_1$–$\mathbf{100}_4$ and a steamer 101. Box $\mathbf{100}_1$ is conventionally known as a pre-scour box; box $\mathbf{100}_2$ is known as a recuperator box; box $\mathbf{100}_3$ is known as a wash box; and box $\mathbf{100}_4$ is known as a Williamson box.

Each box 100 has a two sets of horizontally extending rollers, particularly an upper set of rollers 102 and a lower set of rollers 104. Boxes $\mathbf{100}_2$ and $\mathbf{100}_3$ each have a set of three upper rollers 102 and a set of four lower rollers 104. Longitudinal axes of rollers 102 and 104 extend in a direction perpendicular to the plane of the paper of FIG. 3, which is a width dimension for each box 100. The longitudinal axes of upper rollers 102 are just above an upper limit 106 of side edges of boxes 100; the longitudinal axes of lower rollers 104 are proximate bottoms of boxes 100. Within each box 100, rollers 102 and 104 alternate in physical placement with one another along direction 46 so that (if and to the extent desired) yarn can travel in a generally serpentine path depicted by broken line 110. However, the actual path traveled by yarn 21 of the present invention is instead shown by the bold line which depicts yarn 21.

Box $\mathbf{100}_2$ is of a type which has selectively positionable baffles or partitions 112 extending vertically across the width of the boxes. Three such baffles 112 are provided in box $\mathbf{100}_2$, particularly beneath the first through third upper rollers 102 (the rollers being numbered in the order of direction 46). While the third baffle in box $\mathbf{100}_2$ is obscured by the dark line representing yarn 21, the positions of such baffles are understandable from the foregoing explanation and the two baffles 112 visible in box $\mathbf{100}_2$ of FIG. 3.

Held aloft at an exit of each box 100 is a set of rollers which includes a guide roller and a pair of adjustable nip rollers. For example, at an exit of box $\mathbf{100}_2$ is carrier roller $\mathbf{120}_2$ and upper and lower nip rollers $\mathbf{122}_2$, $\mathbf{124}_2$, respectively. A similar set of rollers is shown for each of boxes $\mathbf{100}_3$ and $\mathbf{100}_4$, each roller being subscripted in accordance with the box which it follows. The pressure applied on yarn 21 as it passes through upper nip roller 122 and lower nip roller 124 is adjustable. For reasons explained hereinafter, in view of the configurations and pressure settings of the present invention, the pair of nip rollers $\mathbf{122}_2$, $\mathbf{124}_2$ are known as solution impressing nip rollers; the pair of nip rollers $\mathbf{122}_3$, $\mathbf{124}_3$ are known as idle nip rollers; and, the pair of nip rollers $\mathbf{122}_4$, $\mathbf{124}_4$ are known as excess solution removal nip rollers.

Above and after the exit of each nip roller pair is a compensator roller 128. For example, after passing between solution impressing nip rollers $\mathbf{122}_2$, $\mathbf{124}_2$, yarn 21 travels over compensator roller $\mathbf{128}_2$ and then down into box $\mathbf{100}_3$.

Beneath each set of rollers 120, 122, 124 is a drain pan 130. Any liquid squeezed from yarn 21 by action of nip rollers 122, 124 falls by force of gravity either into the upstream box 100, or into drain pan 130 and then into the upstream box. For example, liquid squeezed from yarn 21 by solution impressing nip rollers $\mathbf{122}_2$, $\mathbf{124}_2$ falls back into box $\mathbf{100}_2$.

Adaptation and configuration of the apparatus of FIG. 3 for the present invention is now described.

Box $\mathbf{100}_2$ is truncated to one-fourth of full box volume by virtue of positioning of the third baffle 112 and utilizing only the last upper roller 102 and last lower roller 104 of box $100_2$. Only compensator rollers $128_1$ and $128_2$ are utilized. All rollers 102 and 104 of box $100_3$ are utilized. Thus, in accordance with the apparatus configuration of the present invention, yarn 21 travels in the following course: under compensator roller $128_1$, over the last upper roller 102 of box $100_2$; under the last lower roller 104 of box $100_2$; over carrier roller $120_2$; between solution impressing nip rollers $122_2$, $124_2$; over compensator roller $128_2$; in a serpentine path through box $100_3$ (alternatively over an upper roller $102_3$ and a lower roller $104_3$ for all rollers $102_3$ and $104_3$ in box $100_3$); over carrier roller $120_3$; between idle nip rollers $122_3$, $124_3$; directly across and above box $100_4$; over roller $120_4$; between nip rollers $122_4$ and $124_4$; over compensator roller $128_4$; under carrier roller 132; and into steamer 101.

Steamer 101 is of conventional structure, having alternating upper rollers 142 and lower rollers 144 so that yarn 21 also travels a generally serpentine path through steamer 101. A portion of steamer 101 is shown in FIG. 3. Yarn 21 travels the serpentine path through steamer 101. Downstream from steamer 101 in the direction of arrow 46 are a series of development boxes. The development boxes can be used for dyeing, chemical processing, or washing. Although unillustrated in FIG. 3, the development boxes generally resemble boxes 100 of FIG. 3. In accordance with its particularly intended employment, a development box contains indigo or sulfur dye for dyeing purposes, or water or another rinse solution for washing excess solution from yarn 21.

As generally shown in FIG. 1, boxes $100_2$, $100_3$ each receive a pretreatment solution through a T-conduit 150, thereby forming a first bath of solution in box $100_2$ and a second bath of solution in box $100_3$. The pretreatment solution is supplied to conduit 150 by a static mixer 160. Static mixer 160 serves to mix four primary components essentially immediately prior to introduction into $100_2$, $100_3$ as the pretreatment solution. The four primary components of the pretreatment solution are water, a caustic, a wetting agent, and an epoxy ammonium salt. An example of the pretreatment solution is Amdye PTC which is commercially available from American Emulsions of Dalton, Ga.

The components of the pretreatment solution are known from U.S. Pat. Nos. 5,489,313 and 5,330,541 to Hall et al. While in the prior art these components are utilized as a pretreatment solution in a batch-type pretreatment and dyeing process, in the present invention the pretreatment solution is utilized in apparatus for a continuous long chain dyeing operation. However, the prior art pretreatment solution cannot be employed in a continuous operation in manner of batch processing, in part due to the tendency of the pretreatment solution to react with itself. Advantageously, the static mixer and apparatus configuration of the present invention counteract tendencies of the pretreatment solution to react with itself and facilitate use of the pretreatment solution in a continuous operation.

FIG. 1 shows not only the introduction of the pretreatment solution via conduit 150, but also discharge of effluent (indicated by arrows $170_2$ and $170_3$). In terms of the apparatus shown in FIG. 3, the effluent discharges e.g., from orifices formed in boxes $100_2$ and $100_3$. That is, the pretreatment solution is continually introduced at a solution feed rate which is sufficiently fast: (1) to exceed absorption of the solution by yarn 21, and (2) that the pretreatment solution does not have enough time to react with itself before it is flushed out of the box (e.g., through the discharge orifices) by the supply of new solution. Thus, the pretreatment solution is introduced into the first bath at a rate sufficient both to replace pretreatment solution absorbed by yarn 21 and so that the pretreatment solution is discharged from the box substantially before the pretreatment solution has time to react with itself. In the configuration of the present invention, pretreatment solution fills to the levels shown in FIG. 3 as $172_2$ and $172_3$, respectively.

In one example of the invention, warp yarn (7.25/1 yarn count [weight] 100% cotton) of was fed continuously over the path shown in FIG. 3 at a rate of 25 yards per minute, the warp yarn being supplied from twelve ball warps (328 ends each), along the path indicated (box $100_1$ was not utilized). The third baffle 112 of box $100_2$ was utilized so that pretreatment solution entered only the last fourth of box $100_2$ and maintained at level $172_2$, as discussed above. A portion of box $100_3$ was utilized and pretreatment solution supplied therein to level $172_3$. The flow rate of pretreatment solution in conduit 150 out of static mixer 160 was 6 gallons per minute. Effluent discharged from box $100_2$ at a rate of 2.5 gallons per minute; effluent discharged from box $100_3$ at a rate of 0.7 gallons per minute. The temperature of the pretreatment solution in both boxes $100_2$ and $100_3$ was ambient. Solution impressing nip rollers $122_2$, $124_2$, were adjusted to apply a pressure of 50 pounds per square inch (psi), ±2 psi. Idle nip rollers $122_3$, $124_3$, were separated from one another so as not to apply any pressure, i.e., 0 psi. Excess solution removal nip rollers $122_4$, $124_4$ were adjusted to apply a pressure of 10 pounds per square inch (psi), ±2 psi. Steamer 101 was operated at 213.5 degrees Fahrenheit, with a twenty gallon per minute cold spray at its exit end. Upon exiting steamer 101, the warp yarn passed through steamer nip rollers which applied a pressure of 40 psi (±2 psi). Thereafter the warp yarn was continually conveyed through a series of developing boxes which included eight indigo dye boxes; two wash boxes, and one chemical treatment box. Nip roller pressures in these first eight boxes was set to 40 psi (±2 psi). The two wash boxes had water sprays at ten gallons per minute at 120 degrees Fahrenheit. In the last (eleventh) wash box, an acetic acid rinse (120 degrees Farenheit) was applied and nip roller pressure was 50 psi (±2 psi).

In a second example, the treated yarn remained undyed after the preprocessing, so that an uncolored or orginally colored fabric piece 26 was woven. The set up of the second example differed from the first example only in the configuration of the boxes for the development process 44. In particular, in the second example, the warp yarn was continually conveyed through a series of developing boxes which included ten wash boxes and one chemical treatment box. Nip roller pressures in these first ten wash boxes was set to 40 psi (±2 psi). The ten wash boxes had water sprays at ten gallons per minute at 120 degrees Farenheit. In the last (eleventh) wash box, an acetic acid rinse (120 degrees Farenheit) was applied and nip roller pressure was 50 psi (±2 psi).

Figure 2:
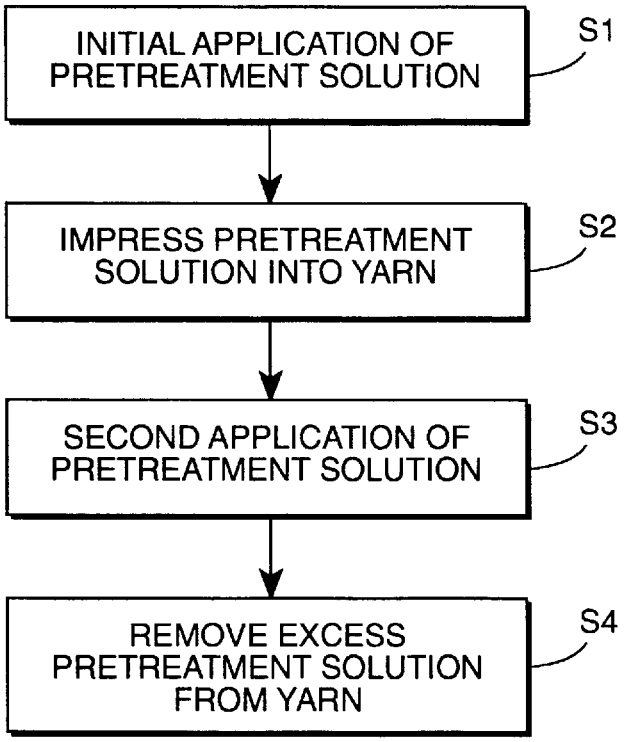
FIG. 2 is a schematic diagrammatic view of details of the yarn pretreatment process of FIG. 1 according to an embodiment of the invention.

In the examples described above, in box $100_2$ the warp yarn had a pick up of 80%. Upon exiting from box $100_3$ the warp yarn had a total pick up of 150% from both boxes. Thus, when essentially dry upon entering box $100_2$, the warp yarn absorbs more pretreatment liquid than it subsequently absorbs in box $100_3$. The initial application of pretreatment solution is depicted by step S1 of the solution application stage 40 of pretreatment process 22 (see FIG. 2).

As indicated above, the pressure exerted by solution impressing nip rollers $122_2$, $124_2$, is 50 pounds per square inch (psi), ±2 psi. Exertion of this pressure by solution impressing nip rollers $122_2$, $124_2$ serves to impress or force the pretreatment solution, which is maximally absorbed in box $100_2$, into the yarn (see step S2 of FIG. 2). However, the pressure also squeezes some of the pretreatment solution out of the yarn. By conveying the warp yarn through the pretreatment solution a second time, i.e., in box $\mathbf{100}_3$, the pretreatment solution is evenly and generously applied to the warp yarn (see step S3 of FIG. 2). Upon exiting the second box $\mathbf{100}_3$, no nip pressure is applied. The yarn is then conveyed over box $\mathbf{100}_4$ (e.g., over roller $\mathbf{124}_3$ to the excess solution removal rollers $\mathbf{122}_4$, $\mathbf{124}_4$), providing further reaction time of the pretreatment solution with the warp yarn. At the rollers $\mathbf{122}_4$, $\mathbf{124}_4$, only sufficient pressure is applied (e.g., 10 psi±2 psi) to remove excess pretreatment solution on the yarn (see step S4 of FIG. 2). Thus, the yarn remains saturated with the pretreatment solution. The warp yarn was then conveyed into steamer 101, wherein a heat reaction occurred to lock the pretreatment solution into the yarn.

In accordance with the present invention, a ratio of the pressure applied to yarn 21 by the solution impressing nip rollers $\mathbf{122}_2$, $\mathbf{124}_2$ (i.e., the "first pressure") to the pressure applied by the excess solution removal rollers $\mathbf{122}_4$, $\mathbf{124}_4$ (i.e., the "second pressure") is in a range of about 4:1 to 6:1, and preferably is about 5:1. A ratio of the volume $V_2$ of pretreatment solution in box $\mathbf{100}_2$ to the volume $V_3$ of pretreatment solution in box $\mathbf{100}_3$ is preferably about 1:2.

After the weaving process 24 (see FIG. 1), either the piece of fabric 26 or article 28 formed therefrom can be dyed in dyeing process 30. As mentioned previously, in accordance with differing modes of the invention, and depending upon the contents of the development boxes, the dyeing process 30 can be either an initial coloring of a treated yarn in the fabric or a further coloring of a previously colored treated yarn in the fabric.

The type of equipment utilized in dyeing process 30 can be a normal continuous dye range, or other garment dyeing apparatus. Dyeing process 30 is conducted on the acid side and avoiding use of anionic chemicals, as is understood for example from U.S. Pat. Nos. 5,489,313 and 5,330,541 to Hall et al., both incorporated herein by reference. As mentioned above, in dyeing process 30 only the treated yarn such as warp yarn 21 is to be dyed, not untreated yarn 23. Such phenomena occurs since dye 32 is attracted solely to treated yarn 21 by virtue of its permeation with the dye-attractive pretreatment solution. Dye 32 is a special dye which has specific functional groups which are attracted to the pretreatment solution on the yarn.

Only after completion of dyeing process 30 will it be apparent whether the application of pretreatment solution in pretreatment process 22 resulted in uniform coloration of the treated yarn. If the treated yarn did not sufficiently and uniformly absorb the pretreatment solution, the resultant dyed article 28' may have unacceptable streaks. However, the present invention ensures adequate uniform absorption by the treated yarn of the pretreatment solution. In the present invention, the pretreatment solution is first soaked (in box $\mathbf{100}_2$) and impressed into the yarn (at rollers $\mathbf{122}_2$ and $\mathbf{122}_4$). Thereafter, the yarn is immersed in a second bath (in box $\mathbf{100}_3$) without subsequent squeezing of pretreatment liquid, only removal of excess solution from the exterior of the yarn (at nip rollers $\mathbf{122}_4$, $\mathbf{124}_4$). Moreover, the turn over rate of pretreatment solution precluded the solution from reacting with itself. The effective volumes of boxes $\mathbf{100}_2$ and $\mathbf{100}_3$ were configured to facilitate the turn over rate, since a greater rate of solution absorption occurs in box $\mathbf{100}_2$ than in box $\mathbf{100}_3$.

While the invention has been particularly shown and described with reference to the preferred embodiments thereof, it will be understood by those skilled in the art that various alterations in form and detail may be made therein without departing from the spirit and scope of the invention. For example, modifications of the apparatus of FIG. 3 are possible. In another configuration mode, baffles of box $\mathbf{100}_2$ are situated so that yarn 21 travels under another one of the lower rollers 104 thereof, box $\mathbf{110}_2$ thereby still being only one-fourth utilized. In another configuration mode, a first box through which yarn 21 travels is filled to a relatively lower level than that indicated by level $\mathbf{172}_2$, with yarn 21 in the box traveling under one or more adjacent lower rollers 104 (there being no baffles between adjacent lower rollers 104 in such box). In these alternate configuration modes, the dwell time of the yarn in box $\mathbf{100}_2$ should be essentially the same as that shown in FIG. 3.

Aspects of the present invention are significant for fabric producers, such as denim producers, in that the dyeing process can be partially or totally deferred (e.g. after article fabrication) until the producer ascertains the market for or need of a particularly colored article. For example, no longer must the ultimate color (e.g., indigo or sulfur, etc.) be affixed to the yarn prior to weaving of the fabric piece. Instead, in view of the present invention, the piece of fabric 26 can be woven with a natural color or an intermediate color. Subsequently, either the piece of fabric 26 can or an article 28 formed therefrom can be dyed to a desired ultimate color. The desired ultimate color can be chosen and determined at a point in time closer to actual marketing thereof.

The embodiments of the invention in which an exclusive property or privilege is claimed are defined as follows:

1. A process for producing of a differentially colored fabric, the process comprising:

(1) treating a first yarn with a pretreatment solution;

(2) weaving the first yarn and a second yarn into a piece of fabric, then (3) treating the piece of fabric with a dye whereby, as a result of a reaction with the dye and the pretreatment solution, the first yarn is colored and any yarn in the fabric which has not been treated with the pretreatment solution remains substantially uncolored.

2. The process of claim 1, wherein step (1) comprises essentially continuously transporting a supply of the first yarn through the pretreatment solution.

3. The process of claim 2, wherein step (1) further includes dyeing the first yarn in a first dyeing process, the first yarn being essentially continuously transported both through the pretreatment solution and then through the first dyeing process, and wherein the treating of the piece of fabric with a dye in step (3) constitutes a second dyeing process for the first yarn.

4. The process of claim 2, comprising:

continuously feeding the first yarn into a first bath of the pretreatment solution;

supplying the pretreatment solution to the first bath of the pretreatment solution;

supplying the pretreatment solution to the first bath at a rate sufficient both to replace pretreatment solution absorbed by the first yarn and to discharge the pretreatment solution from the first bath substantially before the pretreatment solution reacts with itself;

feeding the first yarn between a pair of solution impressing nip rollers to apply a first pressure for padding the pretreatment solution into the first yarn; then continuously feeding the first yarn into a second bath of the pretreatment solution;

feeding the first yarn between a pair of excess solution removal nip rollers to apply a second pressure substantially only for removing excess pretreatment solution from the first yarn, the second pressure being less than the first pressure; then heat treating the first yarn to lock the pretreatment solution into the first yarn.

5. The process of claim 4, wherein a ratio of the first pressure to the second pressure is in a range of about 5:1.

6. The process of claim 4, wherein the first pressure is in a range from 40 psi to 60 psi, and preferably is 50 psi.

7. The process of claim 4, wherein the second pressure is in a range from 6 psi to 14 psi, and preferably is 10 psi.

8. The process of claim 4, wherein the first bath has a first bath solution exchange rate and wherein the second bath has a second bath solution exchange rate, and wherein a ratio of the first bath solution exchange rate to the second bath solution exchange rate is in a range from 1.5:1 to 3:1.

9. The process of claim 4, wherein the first bath has a volume $V_2$ of the solution and the second bath has a volume $V_3$ of the solution, and wherein the ratio $V_2$:$V_3$ is in a range from 1:1 to 1:3, and is preferably 1:2.

10. The process of claim 4, further comprising mixing components of the pretreatment solution essentially immediately prior to introducing the pretreatment solution into the first bath and the second bath.

11. The process of claim 1, wherein the second yarn has not been treated with the pretreatment solution and remains substantially uncolored in step (3).

12. A process for dye pretreatment of a continuously traveling yarn, the process comprising:

essentially continuously feeding the yarn into a first bath of dye pretreatment solution;

supplying the solution to the first bath at a rate sufficient both to replace solution absorbed by the yarn and to discharge the solution from the first bath substantially before the first solution reacts with itself;

feeding the yarn between a first pair of nip rollers to apply a first pressure for padding the solution into the yarn; then essentially continuously feeding the yarn into a second bath of the solution; then feeding the yarn between a second pair of nip rollers to apply a second pressure substantially only for removing excess solution from the yarn, the second pressure being less than the first pressure; then heat treating the yarn to lock the dye pretreatment solution into the yarn.

13. The process of claim 12, wherein a ratio of the first pressure to the second pressure is in a range of about 4:1 to 6:1.

14. The process of claim 12, wherein the first pressure is in a range from 40 psi to 60 psi, and preferably is 50 psi.

15. The process of claim 12, wherein the second pressure is in a range from 6 psi to 14 psi, and preferably is 10 psi.

16. The process of claim 12, wherein the first bath has a first bath solution exchange rate and wherein the second bath has a second bath solution exchange rate, and wherein a ratio of the first bath solution exchange rate to the second bath solution exchange rate is in a range from 1.5:1 to 3:1.

17. The process of claim 12, wherein the first bath has a volume $V_2$ of the solution and the second bath has a volume $V_3$ of the solution, and wherein the ratio $V_2$:$V_3$ is in a range of 1:1 to 1:3 and is preferably 1:2.

18. Apparatus for pretreatment of an essentially continuously traveling yarn, the apparatus comprising:

a first box into which a dye pretreatment solution is both continuously introduced and discharged, the first box having at least one yarn path defining element situated therein;

a solution impressing pair of nip rollers positioned at an exit of the first box, the solution impressing pair of nip rollers applying a first pressure for padding the solution with the yarn;

a second box into which the dye pretreatment solution is both continuously introduced and discharged, the second box having a series of yarn path defining elements situated therein;

an excess solution removal pair of nip rollers for applying a second pressure substantially only for removing excess solution from the yarn;

a heat treatment chamber wherein the solution is locked into the yarn; and, a transport system for continuously feeding the yarn in sequence through the first box, the solution impressing pair of nip rollers, the second box, the excess solution removal pair of nip rollers, and the heat treatment chamber.

19. The apparatus of claim 18, wherein a ratio of the first pressure to the second pressure is in a range of about 4:1 to 6:1.

20. The apparatus of claim 18, wherein the first bath has a first box solution exchange rate and wherein the second box has a second box solution exchange rate, and wherein a ratio of the first box solution exchange rate to the second box solution exchange rate is in a range from 1.5:1 to 3:1.

* * * * *